US009849707B2

(12) United States Patent
Chopra et al.

(10) Patent No.: US 9,849,707 B2
(45) Date of Patent: Dec. 26, 2017

(54) ARCHITECTURE FOR THE PRINTING OF BRAILLE DOTS USING UV GEL INK

(71) Applicant: XEROX CORPORATION, Norwalk, CT (US)

(72) Inventors: Naveen Chopra, Oakville (CA); Christopher A. Wagner, Etobicoke (CA); Michelle N. Chrétien, Mississauga (CA); Jennifer L. Belelie, Oakville (CA); Barkev Keoshkerian, Thornville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/001,525

(22) Filed: Jan. 20, 2016

(65) Prior Publication Data

US 2017/0203597 A1 Jul. 20, 2017

(51) Int. Cl.

| | |
|---|---|
| ***B41J 2/005*** | (2006.01) |
| ***B41J 2/01*** | (2006.01) |
| ***B41M 3/16*** | (2006.01) |

(52) U.S. Cl.
CPC . *B41M 3/16* (2013.01); *B41J 2/01* (2013.01)

(58) Field of Classification Search
CPC ..... B41J 2/0057; B41J 2002/012
See application file for complete search history.

(56) References Cited

U.S. PATENT DOCUMENTS

| | | | | |
|---|---|---|---|---|
| 9,022,546 | B1 * | 5/2015 | Breton | B41M 5/0256 347/102 |
| 2003/0038871 | A1 * | 2/2003 | Shinkoda | B41J 2/01 347/103 |
| 2013/0194366 | A1 | 8/2013 | Chrétien et al. | |
| 2013/0229452 | A1 * | 9/2013 | Roof | B41J 3/32 347/9 |
| 2014/0098153 | A1 * | 4/2014 | Moore | B41J 11/0095 347/16 |

* cited by examiner

*Primary Examiner* — Jason Uhlenhake
(74) *Attorney, Agent, or Firm* — Caesar Rivise, PC

(57) ABSTRACT

An improved apparatus and method for forming images comprising Braille, raised print, regular print, or a combination is described. The architecture for the printing of Braille dots using marking material such as UV gel ink. The UV gel ink is deposited on a drum that has an array of closely packed raised features like mesas that are cup-shaped. The mesas on drum are filled with the UV gel ink and transferred to paper or another substrate. Partial curing can occur on the drum and the dots can be fully cured after transfer to the substrate. The mesas are shaped so that the dots take on a final shape consistent with usual Braille features.

15 Claims, 7 Drawing Sheets

ARCHITECTURE FOR THE PRINTING OF BRAILLE DOTS USING UV GEL INK

BACKGROUND OF THE INVENTION

The present invention relates to the field of printing materials and, more particularly, to a an imaging member having an array of closely packed cup-shaped features thereon and a print substrate onto which the imaging member is adapted to be selectively transferred to print information thereon. Disclosed herein are ultra-violet (UV) curable gellant inks for ink jet printing on a substrate in Braille, raised print, regular print, or a combination thereof. Also described is a method for forming images comprising Braille, raised print, regular print, or a combination thereof with the described UV curable gellant inks.

There are two main technologies available for printing Braille and raised characters: embossing and thermal paper expansion. These devices produce lines made from dots which provide poor image resolution and are unable to print variable height graphs and images. When required, variable height such as graphs are typically fabricated by hand using a thermoforming process. Further, embossers are extremely noisy machines, requiring acoustic cabinets. Thermal expansion paper is also very expensive, typically over a dollar per sheet, requires a complicated and slow two-step printing process, and is limited to specialty plastic-like substrates.

Yet another technology that has been used for printing Braille and raised characters is ink jet printing, which generally employs inks that are solid at room temperature and liquid at elevated temperatures. Such inks may be referred to as solid inks, hot melt inks, phase change inks and the like. While conventional solid ink technology is generally successful in producing vivid images and providing economy of jet use and substrate latitude on different substrates, such technology often does not meet the additional requirements for specialized applications such as Braille and raised print applications. Specifically, solid ink lacks the durability and robustness for a Braille application, and can easily be flaked or rubbed off with repeated contact and rubbing.

As such, there is a need to overcome the deficiencies of conventional printing technology for printing Braille and raised characters to better serve the market. Advantages of digitally producing Braille and raised text are personalization, accessibility to home users, ease of combination with regular text, and the ability to easily generate Braille representations of mathematical and chemical equations and financial formulae. There is a need in the art for a Braille printing process that include rounded dots, a transfuse architecture that is compatible with current solid ink technology, and elimination of teardrop or elongated dots that could possibly be formed in a current direct to paper moving path architecture.

BRIEF SUMMARY OF THE INVENTION

Accordingly, an improved apparatus and method for forming images comprising Braille, raised print, regular print, or a combination is described. The architecture for the printing of Braille dots using marking material such as UV gel ink. The UV gel ink is deposited on a drum that has an array of closely packed raised features like mesas that are cup-shaped. The mesas on drum are filled with the UV gel ink and transferred to paper or another substrate. Partial curing can occur on the drum and the dots can be fully cured after transfer to the substrate. The mesas are shaped so that the dots take on a final shape consistent with usual Braille features. The mesas may also be optionally treated with a non-stick surface coating so as to facilitate the release of the dots during the transfer step from the drum to the substrate.

DETAILED DESCRIPTION OF THE INVENTION

Figure 1:
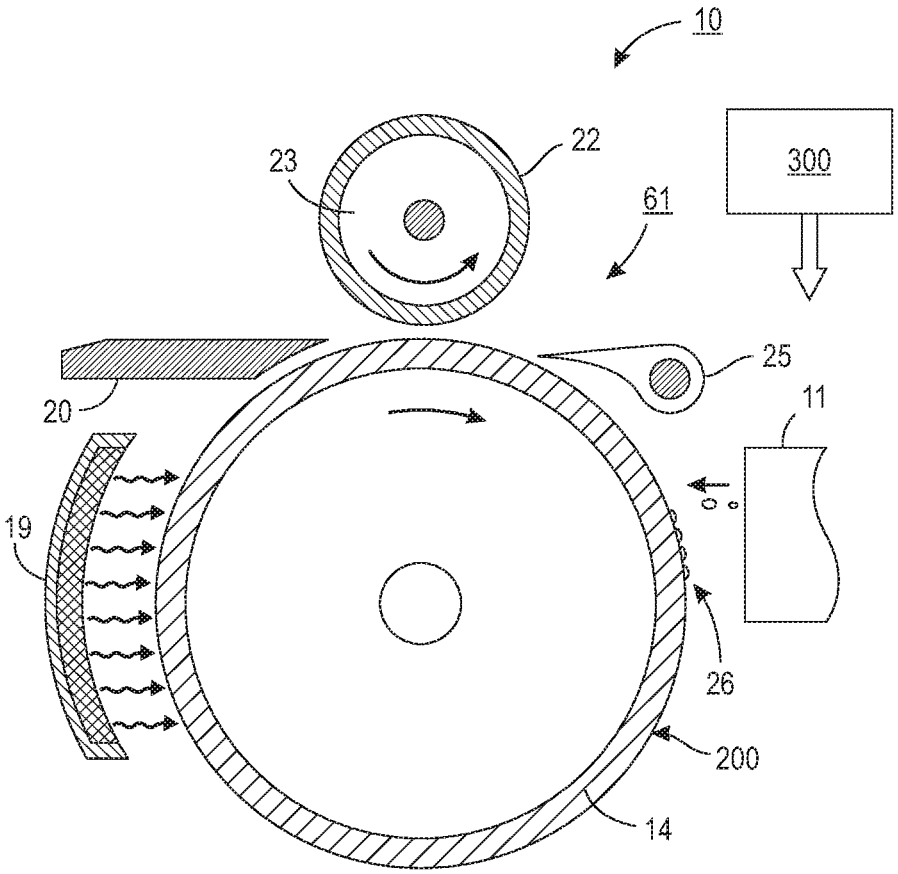
FIG. 1 is a side view of one apparatus for use in conjunction with embodiments herein.

Illustrative examples of the devices, systems, and methods disclosed herein are provided below. An embodiment of the devices, systems, and methods may include any one or more, and any combination of, the examples described below.

Example 1 is an apparatus useful in printing, comprising an imaging member having at least one surface with an array of cup-shaped mesas, each of which includes a mesa surface for carrying a marking material; at least one ink jet print head and a mesa surface toward which the marking material is jetted from the at least one ink jet print head; wherein the imaging member when pressed against a print substrate deposits the marking material on the print substrate.

Example 2 includes the subject matter of Example 1, and wherein a print deposited upon the print substrate is Braille, digital embossing raised print, or a combination of regular print and one or more of Braille, digital embossing and raised print and wherein a height distance between the ink jet print head and the mesa surface is adjustable.

Example 3 includes the subject matter of Example 2, and wherein the marking material is in a viscous non-liquid state at room temperature and transitions to a less viscous liquid state when heated to a temperature useful in a printing.

Example 4 includes the subject matter of Example 1, and wherein the marking material is a gel ink.

Example 5 includes the subject matter of Example 4, and further comprising a radiation source configured to cure a jetted gel ink to increase its viscosity before the imaging member contacts the gel ink on the print substrate in a print process.

Example 6 includes the subject matter of Example 4, and wherein the print substrate comprises a substrate selected from the group consisting of plain paper, ruled notebook paper, bond paper, silica coated paper, glossy coated paper, transparency materials, fabrics, textile products, plastics, polymeric films, metal, and wood.

Example 7 includes the subject matter of Example 4, and wherein the print substrate comprises a currency substrate.

Example 8 includes the subject matter of Example 4, and wherein the print substrate comprises a surface of an intermediate transfer member.

Example 9 includes the subject matter of Example 4, and wherein a print deposited upon a print substrate surface is Braille.

Example 10 includes a method useful in printing, the method comprising using an imaging member having at least one surface with an array of cup-shaped mesas, each of which includes a mesa surface for carrying a marking material; jetting the marking material using at least one ink jet print head toward the mesa surface, wherein a height distance between the ink jet print head and the mesa surface is adjustable; wherein the imaging member when pressed against a print substrate deposits the marking material on the print substrate.

Example 11 includes a system useful in printing, comprising an imaging member having at least one surface with an array of cup-shaped mesas, each of which includes a mesa surface for carrying a marking material; wherein the imaging member when pressed against a print substrate deposits the marking material on the print substrate; a processor; and a storage device coupled to the processor, wherein the storage device contains instructions operative on the processor for: depositing the marking material using at least one ink jet print head on at least one of the cup-shaped mesas, wherein a height distance between the ink jet print head and the mesa surface is adjustable; using a radiation source (such as a UV lamp) configured to cure the ink and increase the ink viscosity before the imaging member contacts the marking material on the print substrate in a print process; and pressing the imaging member against the print substrate to form an array of marking material mesas thereon.

Example 12 includes the subject matter of Example 11, and wherein a print deposited upon the print substrate is Braille, digital embossing raised print, or a combination of regular print and one or more of Braille, digital embossing and raised print; and, wherein the marking material is in a viscous non-liquid state at room temperature and transitions to a less viscous liquid state when heated to a temperature useful in a printing method.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of resistors" may include two or more resistors.

The term "controller" is used herein generally to describe various apparatus relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "print media", "print substrate" and "print sheet" generally refers to a usually flexible, sometimes curled, physical sheet of paper, plastic, or other suitable physical print media substrate for images, whether precut or web fed.

The term "printing device" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" can handle sheets, webs, marking materials, and the like. A printing system can place marks on any surface, and the like and is any machine that reads marks on input sheets; or any combination of such machines.

For illustrative purposes, although the term "fuser" is used herein throughout the application, it is intended that the term "fuser" also encompasses members useful for a printing process or in a printing system including, but not limited to, a fixing member, a pressure member, a heat member, and/or a donor member. In various embodiments, the fuser can be in a form of, for example, a roller, a cylinder, a belt, a plate, a film, a sheet, a drum, a drelt (cross between a belt and a drum), or other known form for a fuser member. A "fuser", as described and claimed herein, may be adapted to be useful in other types of printing, such as solid-inkjet printing, iconography, xerography, flexography, offset printing, and the like.

The term "marking material" as used herein encompasses any colorant or other material used to mark on paper or other print media. Examples of marking material include inks, solid ink, gel ink, toner particles, pigments, and dyes. In "solid ink printing" as used herein refers to a printing technique that generates patterns by application of a solid ink that is temporarily softened to a molten state, sprayed or jetted onto an imaging member such as a transfer drum, and then transferred to the substrate where it solidifies. Solid inks typically consist of a host, e.g. a wax, and a guest, e.g. the color dye. A gel ink is a high viscosity semi-solid with a sharp transition point. Due to their higher viscosity at room temperature, gel inks in printing tend to sit on top of a cool surface such as substrate or drum, even porous substrates such as paper, as compared to standard inks. By curing the ink with a radiation source, such as ultra violet (UV) light the gel ink solidifies on top of the surface like a print substrate without need for drying.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

Figure 2:
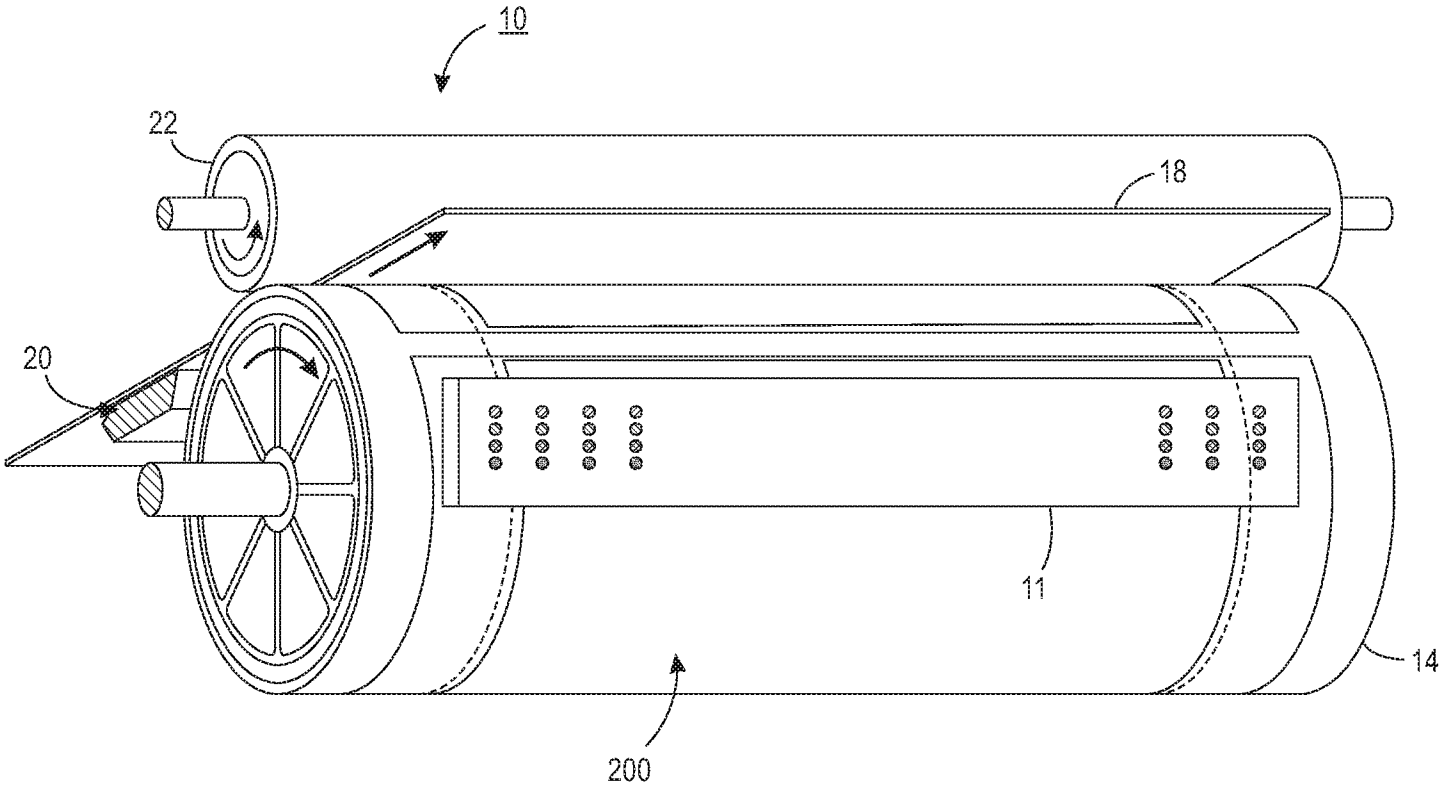
FIG. 2 is a perspective view of an apparatus similar to that shown in FIG. 1.

FIGS. 1 and 2 diagrammatical illustrate an example of a suitable imaging apparatus (apparatus) 10 under the control of controller 300 (FIG. 4) for forming an image on an intermediate transfer member (imaging member) and subsequently transferring that image from the intermediate transfer member to a final image receiving substrate such as a print substrate. The illustrated imaging apparatus 10 includes an intermediate transfer member 14 such as a drum. The illustrated drum has an array of closely packed mesas or cups with each capable of holding marking material. The cups on drum are filled with the UV gel ink and transferred to paper or another substrate. The cups can be manufactured using a raised printing system like the apparatus disclosed in U.S. patent application Ser. No. 13/359,218, entitled "Systems and Methods for Digital Raised Printing," filed on Jan. 26, 2012, by Chrétien et al., and published as US 2013/0194366 on Aug. 1, 2013, which is commonly assigned, and the disclosure of which is hereby incorporated by reference herein in its entirety. The drum may also be treated with a non-stick surface coating to facilitate transferring onto the substrate.

The marking material applicator, in this case an ink jet head 11, applies (jet 26) marking material in an imagewise pattern onto the exterior surface 200 of the intermediate transfer member. This exterior surface 200 primarily encompasses an array of closely packed cup-shaped features (mesas) which the ink jet head 11 jets 26 the marking material in forming an image. The marking material may be a gel ink such as, for example, Xerox® UV Gel ink. A gel ink is a high viscosity semi-solid with a sharp transition point. Due to their higher viscosity at room temperature, gel inks tend to sit on top of a cool substrate, even porous substrates such as paper, as compared to standard inks. However, at certain temperature gel inks tend to suffer from levelness and print-through to the deposited surface. A partial curing would reduce penetration of the ink into pores of the substrate, i.e., print-through, but also allows the partially-cured ink layer to be leveled sufficiently on the drum. The as-leveled ink layer can be subjected to further curing using radiant energy to increase the ink viscosity and surface hardness and adhesion of the ink layer onto the substrate, to provide a robust image. The partial curing of the ink in the mesas with a radiation source, such as a UV light, should only be to a point that the ink can be transfixed to a substrate. If there is too much cure of the ink on the drum, the mesas will be too hard to transfix, and there is no opportunity to cure any further. As noted earlier, the ink can be completely cured downstream when the mesas are affixed onto the print substrate.

After the marking material is deposited in the mesas, the material may be irradiated with UV radiation by a UV source such as UV lamp 19 to partially cure the ink on the surface of the drum. An additional UV lamp similar to UV lamp 19 (not shown) may also be configured to fully polymerize (cure) the ink image to produce a final cured image on the print substrate. Optional heater at or near the substrate guide 20 may also be employed to supply heat to facilitate the transfer process before or after the ink film on the imaging member is pressed against a print substrate 18 to deposit or transfer the marking material on the print substrate.

In an alternative embodiment, radiation curable gel ink may be irradiated with radiation sources other than UV sources, and may be irradiated by systems such as e-beam (electron beam) systems.

In the Figures, the imaging member or intermediate transfer member 14 is shown as a roll or drum. However, it may have any suitable form, for example including a belt, web, platen, or any other suitable design.

As shown in FIGS. 1 and 2, the apparatus may also include a transferring apparatus 61 including, for example, a transfer roll 22 where the imagewise pattern of marking material from the intermediate transfer member surface is transferred onto an image receiving substrate 18. An optional image receiving substrate guide 20 may be used to pass the image receiving substrate from a feed device (not shown) and guide the substrate through the nip formed by the opposing actuated surfaces of the roll 22 and the intermediate transfer member 14. Optional stripper fingers 25 may be mounted to the imaging apparatus 10 to assist in removing the image receiving substrate from the surface of the intermediate transfer member 14. Roll 22 may have a metallic core 23, such as steel, with an elastomeric cove ring such as, for example, urethanes, nitrites, ethylene propylenediene monomer rubber (EPDM), and other appropriately resilient materials. Fusing of the image on the print substrate may also be effected at this transferring apparatus.

Once the image 26 enters the nip, it is transferred to its final image conformation and adheres or is fixed to the image receiving substrate either by the pressure exerted against the image 26 on the substrate 18 by the roll 22 alone. UV curing lamp 19 is a radiation source configured to partially cure the jetted gel ink to increase the viscosity before the imaging member contacts the gel ink on the print substrate in a print process. Optional heater (not shown) may also be employed to supply heat to facilitate the process after the imaging member is pressed against a print substrate 18 to deposit the marking material on the print substrate.

Figure 3:
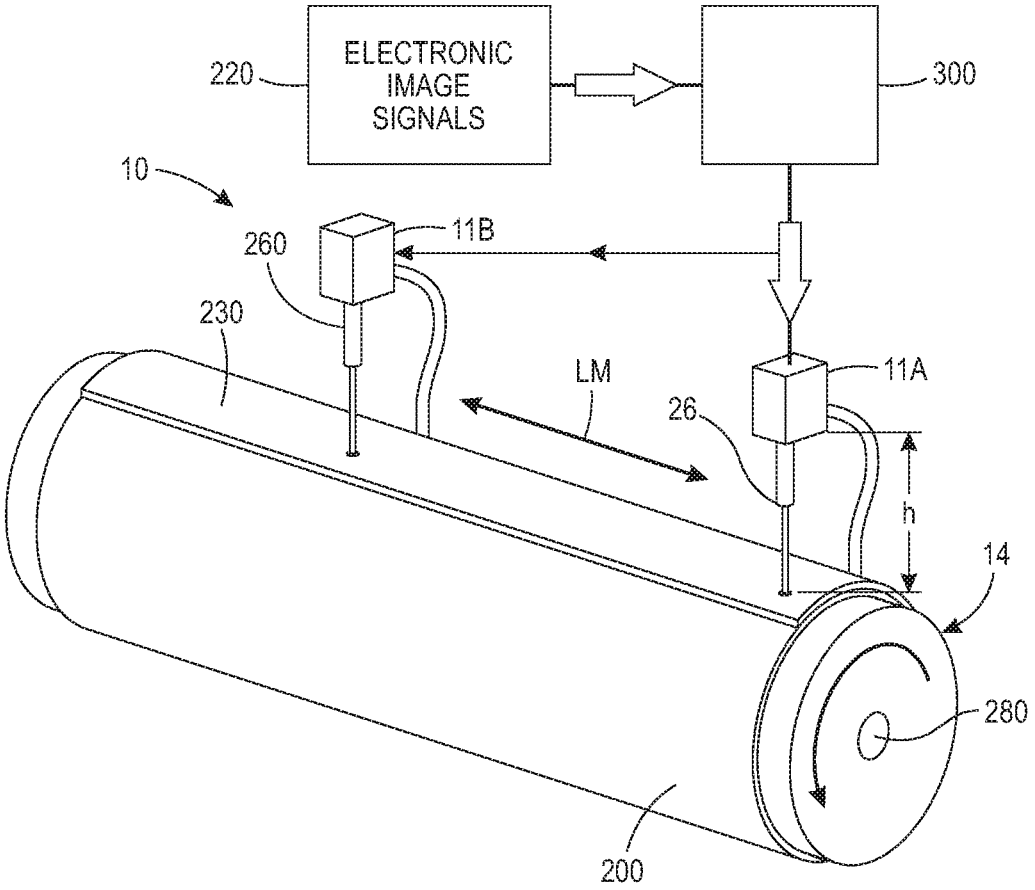
FIG. 3 is a schematic illustration of an apparatus which is responsive to electronic image signals for providing marking material of a recorded image into selected cavities of a plurality of mesas on an imaging member.

The ink jet print head 11 may be supported by an appropriate housing and support elements (not shown). In conventional image forming devices, the ink jet print head is mounted so as to be stationary, or at most is mounted so as to be a fixed distance (h as shown in FIG. 3) from the drum surface but movable axially across the face of the drum, for example movable in a direction toward and away from a viewer viewing FIG. 1. In embodiments herein, the UV gellant inks are designed to work with the surface composition of the drum.

In the apparatus of embodiments herein, however, the ink jet print head comprises a mechanism to adjust the distance relative to the print region surface, also referred to herein as the height distance between the ink jet print head and the print region surface. The use of a single print head could limit the speed of print since the depositing process would require printing or ejecting multiple drops to produce a desired feature. This speed print issue, however, could be addressed by multiple means, such as by incorporating additional print heads, adjusting the height distance, plurality of sequentially application of ink layers, or by employing print heads that have higher native firing frequencies.

In embodiments, the regular height position (h) of the ink jet print head will represent a first height distance, which may be a minimum height distance, between the ink jet print head and the print region surface, and in which the print head is at its closest position to the surface of the drum.

While this first position of the ink jet print head is acceptable for printing regular height single or multi-color images, a difficulty arises when attempting to form raised height images for print substrate in such print process like Braille, digital embossing raised print, or a combination of regular print and one or more of Braille, digital embossing and raised print. For example, for Braille applications, the height of the image should be at least about 200 micrometer in order for the image to be readily detected and properly deciphered by touch. If it is attempted to build-up the height of the image to over 200 μm, for example through known techniques such as multiple passes, i.e., multiple drops, with the ink jet print head, the ink jet print head will ultimately contact and damage the printed image when using paper and the like. There is thus a print height limit beyond which a standard ink jet printing device cannot print. This is why standard ink jet printers are not used in forming raised height images, and why users are forced to purchase separate printing devices that are dedicated to forming raised height images.

Herein to overcome a multiple drop limitation, it is proposed to include additional print heads or print heads that have higher native firing frequencies. Capabilities of print heads are primarily governed by kinetic power (kinetic energy per unit time) of an ejected droplet; m=mass of an ejected droplet; v=velocity of an ejected droplet; and fmax=maximum frequency of ejection (i.e., the inverse of the ejection plus refill time). As can be seen from the relationship using a print head with increased frequency of ejection and adding or sharing the workload between multiple print heads would void any multiple drop limitations.

Herein the print head is adjustable in spacing with respect to the image member surface so as to permit the ink jet print head to be moved from a first position for regular height printing to a second height distance that is greater than the first height distance. The second height distance is not fixed, and can be varied as necessary for a given printing. Moreover, the second height distance can itself be changed during a printing, as necessary. For example, it may be desirable to adjust the height distance from the first position to a second position as an image is built-up by the ink jet print head, and then as the image continues to be built-up, to adjust the ink jet print head from the second position to a third position in which the spacing from the print region surface is even further increased, and so on as necessary to complete build-up of the image.

In building up an image, for example by way of multiple passes of the print head over the portions of the image to include raised images an appropriate number of passes or ink jetting may be selected so that a raised image can be built up to a desired total print height in accordance to the standards set by the National Library For The Blind And Physically Handicapped Materials Development Center can be achieved. Specifically, the standards are dot height: 0.020 inches (0.51 mm); dot spacing: 0.09 inches (2.29 mm); character spacing: 0.240 inches (6.10 mm); and line spacing: 0.40 inches (10.16 mm).

The ink jet head may support single color or full color printing. In full color printing, the ink jet head typically includes different channels for printing the different colors. As illustrated in FIG. 2, the ink jet head may include four different sets of channels, for example one for each of cyan, magenta, yellow and black. In such embodiments, the print head is capable of printing either full color regular height prints when the ink jet head is set at a minimum distance from the print region surface, or raised height prints of any color combination when the ink jet head is at a distance greater than the minimum distance from the print region surface.

In adjusting the height of the ink jet print head with respect to the print region surface, any suitable height adjustment mechanism may be used. The height adjustment mechanism may be associated with either the ink jet print head or the imaging member surface both could made by controller 300. The height adjustment mechanism may include any type of mechanism, for example rollers and the like, that may be used to move or pull the path of the belt further away from the ink jet print head, and thus it is quite possible to have a height adjustment mechanism associated with the print region surface. For the ink jet print head, any suitable height adjustment mechanism may be used. For example, the housing of frame upon which the ink jet print head is mounted may include an actuator (or micro-actuators controlled by controller 300) for making the appropriate adjustments in the height distance.

FIG. 3 is a schematic illustration of an apparatus 10 which is responsive to electronic image signals 220 for providing marking material of a recorded image into selected cavities of a plurality of mesas (230) on an imaging member. Note that portions which are the same as those in the first embodiment described above are denoted by the same reference numerals, and descriptions of the same portions as those as in the first embodiment will be omitted.

FIG. 3 of the drawings shows, in schematic form, the basic components of the apparatus 10 which is responsive to the application of electronic image signals 220 for providing a hard copy print of an electronically recorded optical image or scene on a print substrate 18 by effecting the selective transfer of an array of closely packed cup-shaped mesas (not shown). Apparatus 10 includes an elongated cylindrical drum 14 mounted for rotation about its axis 280 and having an exterior surface 200 on which the print substrate 18 is wrapped for support and rotation with drum 14. Apparatus 10 also includes a printing head 11*a* (an optional print head 11*b* is also shown) mounted for linear motion (LM) along the length of the drum 14 in alignment with a fixed position and having mounted thereon at least a dispensing mechanism 260 for jetting the marking material into one of the mesas or wells on the surface of drum 14. Under the control of controller 300 the print heads 11*a* and 11*b* can be commanded or actuated to reduce the distance (h) between the jetting nozzle and the exterior surface 200 of the imaging member such as drum 14. Print heads 11*a* and 11*b* could operate in tandem along many rows or one row of drum 14, assuming a row is defined along the length of drum 14, and each print head would be responsible for depositing marking material on the assigned area of the drum 14 or segment of the row. In the alternative each of the print heads 11*a* and

11*b* could be assigned their own respective rows for dispensing the marking material.

Figure 4:
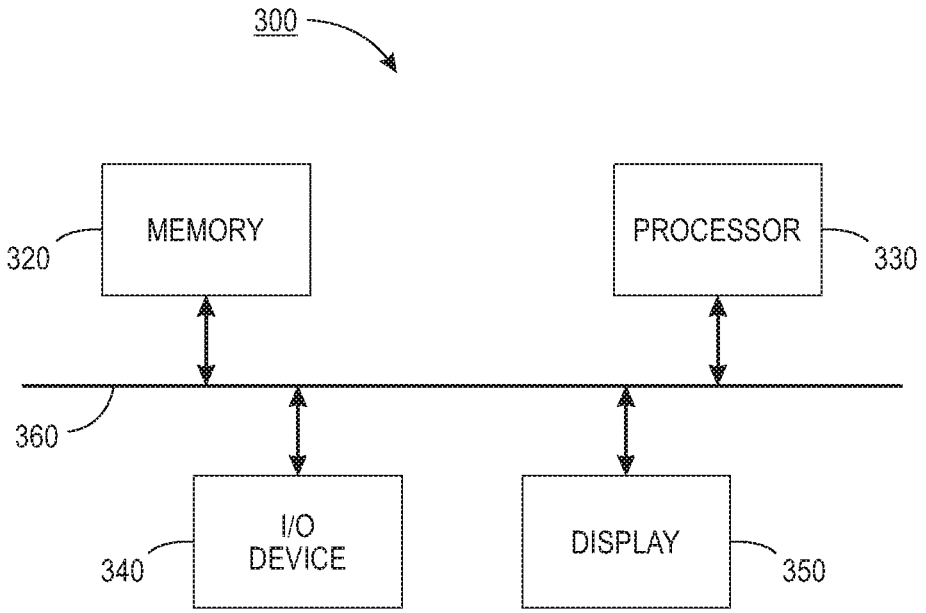
FIG. 4 illustrates a block diagram of a controller with a processor for executing instructions to automatically control devices in the apparatus illustrated in FIG. 1 in accordance to an embodiment.

FIG. 4 illustrates a block diagram of a controller 300 with a processor for executing instructions to automatically control devices in the apparatus illustrated in FIG. 1 in accordance to an embodiment.

The controller 300 may be embodied within devices such as a desktop computer, a laptop computer, a handheld computer, an embedded processor, a handheld communication device, or another type of computing device, or the like. The controller 300 may include a memory 320, a processor 330, input/output devices 340, a display 330 and a bus 360. The bus 360 may permit communication and transfer of signals among the components of the controller 300 or computing device.

Processor 330 may include at least one conventional processor or microprocessor that interprets and executes instructions. The processor 330 may be a general purpose processor or a special purpose integrated circuit, such as an ASIC, and may include more than one processor section. Additionally, the controller 300 may include a plurality of processors 330.

Memory 320 may be a random access memory (RAM) or another type of dynamic storage device that stores information and instructions for execution by processor 330. Memory 320 may also include a read-only memory (ROM) which may include a conventional ROM device or another type of static storage device that stores static information and instructions for processor 330. The memory 320 may be any memory device that stores data for use by controller 300.

Input/output devices 340 (I/O devices) may include one or more conventional input mechanisms that permit data between component of apparatus 10 and for a user to input information to the controller 300, such as a microphone, touchpad, keypad, keyboard, mouse, pen, stylus, voice recognition device, buttons, and the like, and output mechanisms for generating commands, voltages to power actuators, motors, and the like or information to a user such as one or more conventional mechanisms that output information to the user, including a display, one or more speakers, a storage medium, such as a memory, magnetic or optical disk, disk drive, a printer device, and the like, and/or interfaces for the above. The display 330 may typically be an LCD or CRT display as used on many conventional computing devices, or any other type of display device.

The controller 300 may perform functions in response to processor 330 by executing sequences of instructions or instruction sets contained in a computer-readable medium, such as, for example, memory 320. Such instructions may be read into memory 320 from another computer-readable medium, such as a storage device, or from a separate device via a communication interface, or may be downloaded from an external source such as the Internet. The controller 300 may be a stand-alone controller, such as a personal computer, or may be connected to a network such as an intranet, the Internet, and the like. Other elements may be included with the controller 300 as needed.

The memory 320 may store instructions that may be executed by the processor to perform various functions. For example, the memory may store instructions to deposit the marking material using at least one ink jet print head on at least one of the cup-shaped mesas. Maneuver or change the height distance between the ink jet print head 19 and the mesa surface. Instructions so as to use a UV radiation source to increase a jetted marking material viscosity before the imaging member contacts the marking material on the print substrate in a print process; instructions to control the print heads, motion of the drum, and to convert the electronic image signals 220 into control commands for the print heads and movement of the drum; and, control instructions to press the imaging member against the print substrate to form an array of marking material mesas thereon.

Figure 5A:
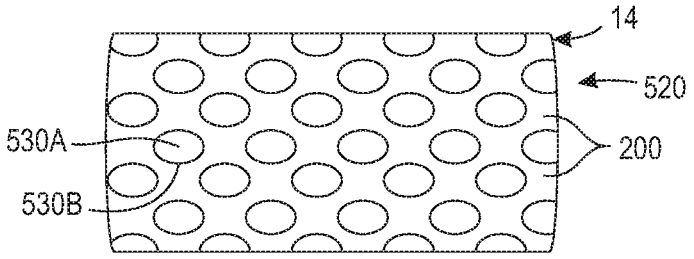
FIG. 5A is a top view of the printing surface of an imaging member in accordance to an embodiment.
Figure 5B:
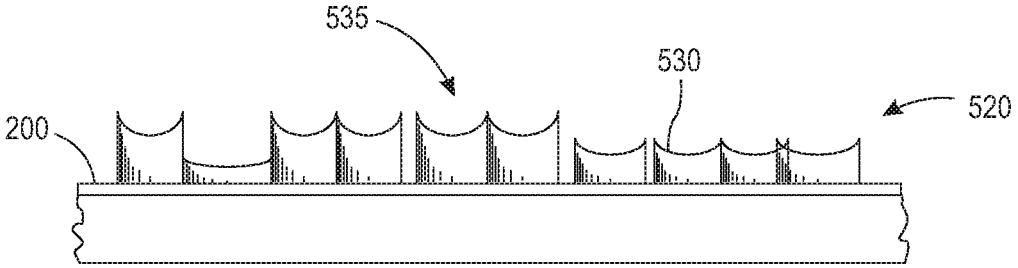
FIG. 5B is an enlarged fragmentary cross-sectional view of a plurality of cup-shaped marking material wells in accordance to an embodiment.

FIG. 5A is a top view of the printing surface of an imaging member in accordance to an embodiment; and, FIG. 5B is an enlarged fragmentary cross-sectional view of a plurality of cup-shaped marking material wells in accordance to an embodiment. FIGS. 5A and 5B illustrate the patterns formed on the surface 200 of drum 14, the pattern is generally indicated by the reference numeral 520 and comprises a suitable web of cured polymeric material having an outer surface 535 thereof embossed with a mirror image of the desired pattern for forming the ink wells 530 each forming an array of cup-shaped mesas that extend outwardly therefrom which will respectively form the individual ink wells in the printing surface or exterior surface 200 of the outer layer of drum 14. Each ink well 530 has mouth opening 535B for receiving the ink and an enclosed surface 530B for carrying the jetted ink. The non-patterned surface, generally the inter-mesa gap, of printing surface could be made or sprayed with a solution that would make it oleophobic, i.e., a non-stick surface, which naturally rejects all ink because of its very low dynamic cohesive energy. Mouth opening 535B generally can take any shape. However, there is a preference for rounded drops because rounded features at receiving layer (mesa) would ensure correct geometry for Braille dots with no sharp edges and a reusable nonstick surface at drum 14 would ensure transfer to the print substrate.

Figure 5C:
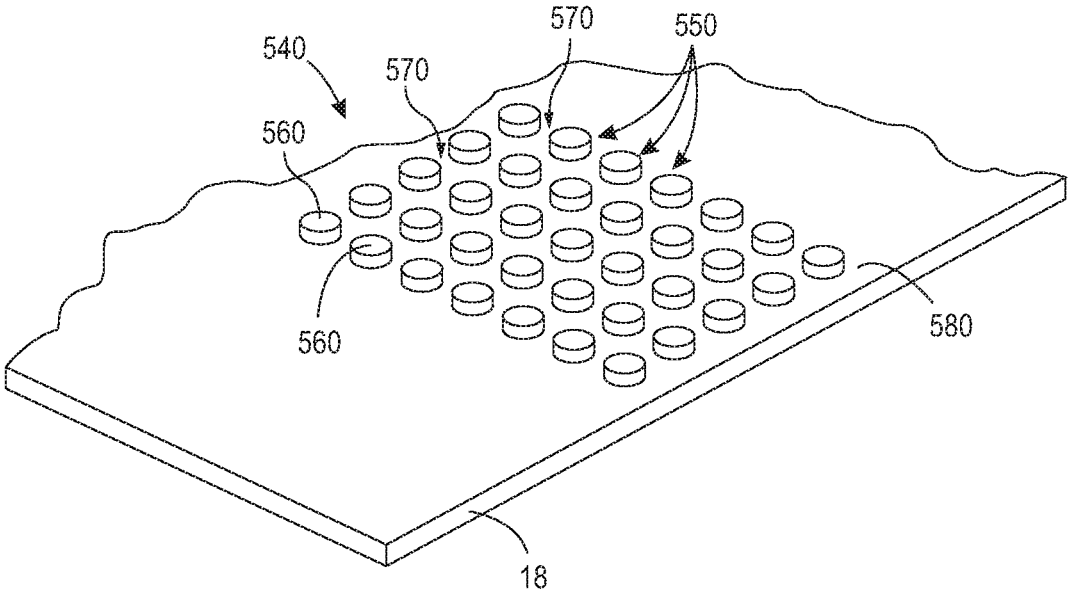
FIG. 5C is a perspective view of a portion of a print substrate embodying the present invention and including a textured printing medium transferred surface; and, FIG. 6 shows a marking material depositing and transferring process in accordance to an embodiment.

FIG. 5C is a perspective view of a portion of a print substrate embodying the present invention and including a textured printing medium transferred surface. FIG. 5C shows a print substrate 18 after it has been pressed against the imaging member (drum 14), which deposits the marking material 580 on the print substrate 18 in accordance to an embodiment. The deposited material like in drum 14 is arranged (540) as an array of closely packed cup-shaped features. As shown each of the cup-shaped mesas 550 include an uppermost circular planar surface 560 and the spaces 570 between next adjacent cup-shaped mesa surfaces 550.

Figure 6:
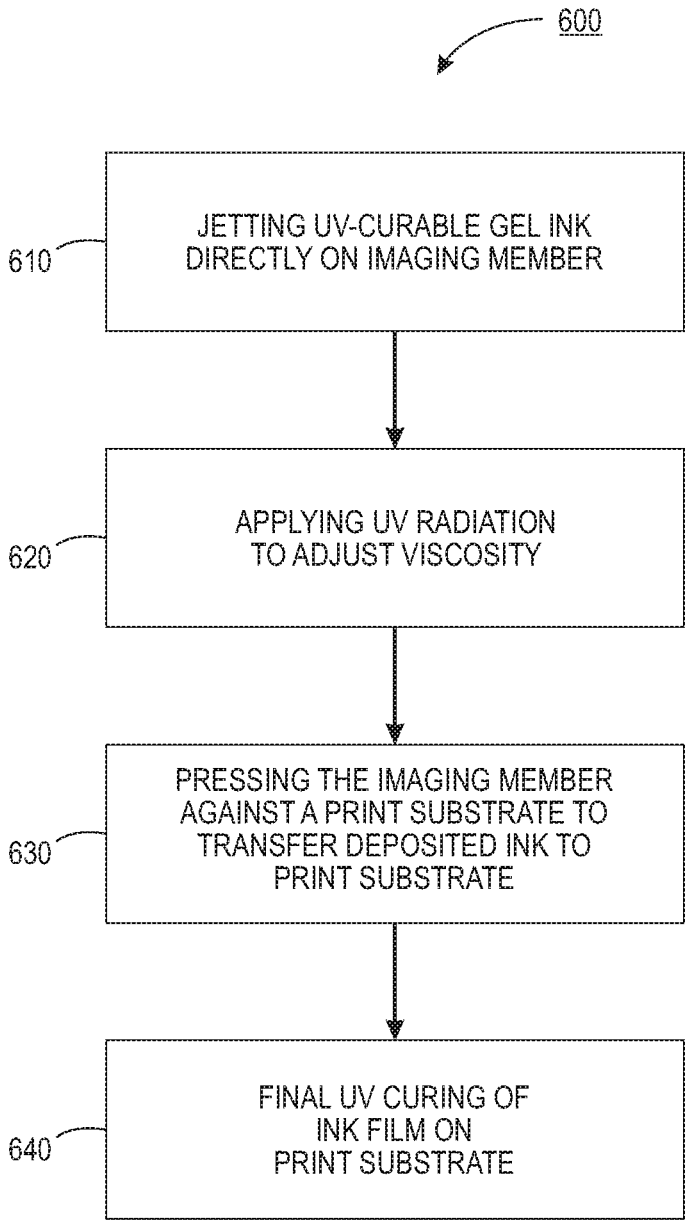

FIG. 6 shows a marking material depositing and transferring process 600 in accordance to an embodiment. The processes of the present invention are performed by processor 330 using computer implemented instructions, which may be located in a memory such as, for example, memory 320, storage device, or in one or more peripheral device connected to bus 360 or through I/O 340. With reference to FIG. 4, a block diagram of a data processing system is shown in which the present invention may be implemented. Process 600 begins with action 610 by jetting UV-curable gel ink directly on imaging member. The marking material is deposited into selected mesas forming a column of ink within each cavity. Control is then passed to action 620 for further processing with heat.

In action 620, the processor applies UV radiation to partially cure and adjust the viscosity of the deposited marking material. When the marking material is a UV gel, when exposed to a curing source (e.g., ultraviolet light), the photointiators in the ink are cleaved to form free radicals, which trigger the free-radical polymerization of the acrylate monomers present in the UV gel ink to partially polymerize (cure) the ink and raise the viscosity and facilitate transfer. When applying UV radiation, the processor, preferably, powers the lamp 19 to apply UV radiation to the gel ink in the array cup-shaped mesas and/or at the print substrate to polymerize enough of the gel ink to alter a viscosity of the ink before the ink is contacted by roll 22. Partial curing can occur on the drum and the mesas (dots) can be fully cured after transfer to the print substrate 18 by a separate heating process such as action 640.

Process 600 could also include an optional pause or delay so as to allow the ink to at least partially set or to optimize the curing point before the mesas are transfixed to the print substrate.

After application of radiation to partially cure the ink in the mesas, control is transferred to action 630 where the processor instructs roller 23 and other devices to press the imaging member against a print substrate to transfer deposited ink to the print substrate like shown in FIG. 5C. As noted earlier further curing can be performed on the mesas after transferring to the print substrate.

Embodiments of the present disclosure address the problem of Braille and raised printing. Embodiments have been disclosed that propose architecture for the printing of Braille dots using UV gel ink. The UV gel ink is deposited on a drum that has an array of closely packed cup-shaped features (mesas). The mesas or cups on drum are filled with the UV gel ink and transferred to paper or another substrate. Partial curing can occur on the drum and the dots can be fully cured after transfer to the substrate. The cups are shaped so that the dots take on a final shape consistent with usual Braille features like round and devoid of jagged edges that can ruin the tactile experience. While the printing of multiple drops to produce the feature is a limiting factor in speed of print. The issue has been addressed by multiple means, such as additional print heads or print heads that have higher native firing frequencies. The drum with the cup-shaped feature can be a modified patterned rolls like those prepared for gravure and flexographic print industries. Benefits of the embodiments include a rounded feature of the receiving layer to ensure correct geometry for Braille dots with no sharp edges, a reusable nonstick surface that substantially ensures one hundred percent (100%) transfer to the print substrate, and a transfuse architecture that is compatible with current technologies.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus useful in printing, comprising:

an imaging member having at least one surface with an array of cup-shaped mesas, each of which includes a mesa surface for carrying a marking material;

at least one ink jet print head and a mesa surface toward which the marking material is jetted from the at least one ink jet print head;

a radiation source configured to cure a jetted gel ink to increase its viscosity before the imaging member contacts the marking material on a print substrate in a print process;

wherein the imaging member when pressed against the print substrate deposits the marking material on the print substrate to produce a receiving layer with a rounded feature and no sharp edges;

wherein the marking material is a gel ink;

wherein a print deposited upon the print substrate is Braille, digital embossing raised print, or a combination of regular print and one or more of Braille, digital embossing and raised print; and wherein a height distance between the ink jet print head and the mesa surface is adjustable;

wherein the height distance is adjusted as an image is built-up by the ink jet print head.

2. The apparatus of claim 1, wherein the marking material is in a viscous non-liquid state at room temperature and transitions to a less viscous liquid state when heated to a temperature useful in printing.

3. The apparatus of claim 1, wherein a cup-shaped mesa extends outwardly to form an individual ink well at the imaging member.

4. The apparatus of claim 3, wherein the print substrate comprises a substrate selected from the group consisting of plain paper, ruled notebook paper, bond paper, silica coated paper, glossy coated paper, transparency materials, fabrics, textile products, plastics, polymeric films, metal, and wood.

5. The apparatus of claim 3, wherein the print substrate comprises a currency substrate.

6. The apparatus of claim 3, wherein the print substrate comprises a surface of an intermediate transfer member.

7. The apparatus of claim 3, wherein a print deposited upon a print substrate surface is Braille.

8. A method useful in printing, the method comprising:

using an imaging member having at least one surface with an array of cup-shaped mesas, each of which includes a mesa surface for carrying a marking material;

jetting the marking material using at least one ink jet print head toward the mesa surface;

wherein the imaging member when pressed against a print substrate deposits the marking material on the print substrate producing a layer with rounded features and no sharp edges;

wherein the marking material is a gel ink and wherein a height distance between the ink jet print head and the mesa surface is adjustable;

wherein the height distance is adjusted as an image is built-up by the ink jet print head;

using a UV radiation source configured to increase a jetted gel ink viscosity before the imaging member contacts the gel ink on the print substrate in a print process;

wherein a print deposited upon the print substrate is Braille, digital embossing raised print, or a combination of regular print and one or more of Braille, digital embossing and raised print.

9. The method of claim 8, wherein the marking material is in a viscous non-liquid state at room temperature and transitions to a less viscous liquid state when heated to a temperature useful in printing.

10. The method of claim 8, wherein a cup-shaped mesa extends outwardly to form an individual ink well at the imaging member.

11. The method of claim 10, wherein the print substrate comprises a substrate selected from the group consisting of plain paper, ruled notebook paper, bond paper, silica coated paper, glossy coated paper, transparency materials, fabrics, textile products, plastics, polymeric films, metal, and wood.

12. The method of claim 10, wherein the print substrate comprises a currency substrate.

13. The method of claim 10, wherein the print substrate comprises a surface of an intermediate transfer member.

14. The method of claim 10, wherein a print deposited upon a print substrate surface is Braille.

15. A system useful in printing, comprising:

an imaging member having at least one surface with an array of cup-shaped mesas, each of which includes a mesa surface for carrying a marking material;

wherein the imaging member when pressed against a print substrate deposits the marking material on the print substrate producing a layer with rounded features and no sharp edges;

a processor; and a storage device coupled to the processor, wherein the storage device contains instructions operative on the processor for:

depositing the marking material using at least one ink jet print head on at least one of the cup-shaped mesas, wherein a height distance between the ink jet print head and the mesa surface is adjustable;

using a UV radiation source configured to cure a jetted marking material to increase its viscosity before the imaging member contacts the marking material on the print substrate in a print process; and pressing the imaging member against the print substrate to form an array of marking material mesas thereon;

wherein a print deposited upon the print substrate is Braille, digital embossing raised print, or a combination of regular print and one or more of Braille, digital embossing and raised print; and, wherein the marking material is in a non-liquid state at room temperature and the marking material has a viscosity of a liquid when heated to a temperature useful in a printing method;

wherein the marking material is a gel ink and wherein a height distance between the ink jet print head and the mesa surface is adjustable;

wherein the height distance is adjusted as an image is built-up by the ink jet print head.

* * * * *